US007385506B2

(12) United States Patent
Shibata et al.

(10) Patent No.: US 7,385,506 B2
(45) Date of Patent: Jun. 10, 2008

(54) BREAK-IN DETECTION SENSOR

(75) Inventors: Norihiko Shibata, Chigasaki (JP); Fumiaki Tsuchiya, Ichikawa (JP); Toshihiro Nozawa, Hitachi (JP); Shinya Ishi, Hitachi (JP)

(73) Assignee: Sanki Eng., Co., Ltd., Tokyo (JP)

( * ) Notice: Subject to any disclaimer, the term of this patent is extended or adjusted under 35 U.S.C. 154(b) by 287 days.

(21) Appl. No.: 11/336,962

(22) Filed: Jan. 23, 2006

(65) Prior Publication Data

US 2006/0197665 A1 Sep. 7, 2006

(30) Foreign Application Priority Data

Jan. 26, 2005 (JP) ..... 2005-017600

(51) Int. Cl.
*G08B 13/18* (2006.01)

(52) U.S. Cl. ..... 340/557; 340/555; 250/227.16

(58) Field of Classification Search ..... 340/557, 340/555, 556, 564, 541; 250/227.16; 398/214
See application file for complete search history.

(56) References Cited

U.S. PATENT DOCUMENTS 4,482,890 A * 11/1984 Forbes et al. ..... 340/556
5,134,386 A * 7/1992 Swanic ..... 340/557
5,194,847 A * 3/1993 Taylor et al. ..... 340/557
6,317,043 B1 * 11/2001 Berk ..... 340/555
6,801,128 B1 * 10/2004 Houston ..... 340/556
6,980,108 B1 * 12/2005 Gebbia et al. ..... 340/555
7,206,469 B2 * 4/2007 Murphy et al. ..... 340/557
2003/0189487 A1 * 10/2003 Mathews et al. ..... 340/556
2004/0183678 A1 * 9/2004 Jaffrey ..... 340/557

FOREIGN PATENT DOCUMENTS

JP 2001-296111 10/2001

* cited by examiner

*Primary Examiner*—John Tweel, Jr.
(74) *Attorney, Agent, or Firm*—Manabu Kanesaka

(57) ABSTRACT

Intrusion by climbing or jumping over a fence can be detected, and intrusion is detected in a wide area without large-scale equipment. FBGs (grating sections) of different types having different refractive indexes of fiber glass are arranged at predetermined intervals in a longitudinal direction of optical fibers 12, 13A, and 13B, the optical fibers are laid down between poles on the top of a fence or a side thereof, reflected waves from the FBGs are issued by photodetection devices 14, 15A, and 15B in response to an optical input to the optical fibers, and a wavelength shift detection device 16 detects a position of an FBG which exhibits a wavelength shift by swinging of the optical fibers by a stress acting on the fence. A pattern recognition device 19 fetches positions of the wavelength-shifted FBGs as differences between timings of the pulse signals and discriminates swinging of the fence caused by intrusion from swinging of the fence caused by other factors on the basis of output patterns of the pulse signals.

6 Claims, 5 Drawing Sheets

BREAK-IN DETECTION SENSOR

BACKGROUND OF THE INVENTION

1. Field of the Invention

The present invention relates to a break-in detection sensor for detecting intrusion into a building or premises by an optical fiber sensor and, more particularly to, a system in which an optical fiber detection sensor of an FBG type is laid down on a side of a fence or the top thereof to detect intrusion.

2. Description of the Related Art

In recent years, security against terrorism or illegal intrusion in airports, harbors, defense facilities, and other important places attracts attention. Various break-in detection apparatuses or break-in detection systems for detecting intrusion into buildings or premises are proposed and executed.

As detection sensors used in the apparatuses and systems of this type include a vibration sensor, an infra-red ray interception sensor, an electric field interception sensor, a mechanical tension sensor, and an abnormal state sensor for surveillance image obtained by a surveillance monitor are known. Furthermore, an optical fiber sensor using an optical fiber is proposed (for example, see Japanese Patent Application Laid-Open (JP-A) No. 2001-296111).

As surveillance systems operated in coordination with the detection sensors, a recording method of ITV camera images and remote monitoring, an image analysis method, a method using alarm generation by an alarm unit and wireless communication are known.

As other detection sensors using optical fibers, optical fiber detection sensors of an FBG (Fiber Brag Grating) type and an OTDR (Optical Time Domain Reflectometry) type are known.

FIG. 3 shows the principle of the FBG type fibro-optic detection sensor. As shown in FIG. 3, grating sections (FBG) 101 having different fiber glass refraction indexes are provided at predetermined intervals in longitudinal cross section through an optical fiber 100. The grating sections 101 resonate and reflect only components having the wavelength of two times the interval λL out of pulse lights coming from an optical signal generator 102. The thus reflected light has a wavelength shifted in proportion to stretch strain in the grating sections 101. The reflected light component is guided by a half mirror 103 through a narrow band variable filter 104 to a light receiver 105 for detection. By checking the degree of wavelength shifts (frequency shifts), it can be detected whether or not the stretch strain in the optical fiber exceeds a predetermined value. When this detection is executed, the positions of the grating sections 101 can be discriminated as positions of intrusion.

FIG. 4 explains the principle of an OTDR fiber-optic detection sensor. An optical fiber includes sections having different refraction factors. When light passes through the sections, the light is refracted and scattered due to the different refraction factors such that light rays having wave lengths equal to that of the incident light are reflected on an end of the optical fiber on which the light is incident. The OTDR fiber-optic detection sensor makes use of this Rayleigh scattering light, where a light pulse issued from a light pulse generator 106 is introduced into the optical fiber 107 before Rayleigh scattering light produced therein is guided out thereof via a half mirror 108 to be received by a receiver 109 where any optical fiber strain, displacement and disconnection points can be detected on the basis of the amount of light or the time required for reflection.

In the break-in detection apparatus using the FBG type fibro-optic detection sensor or the OTDR fibro-optic detection sensor, an optical fiber is laid down along a fence or a wall of premises or facilities to be detected to make it possible to detect intrusion. In particular, in the FBG type fibro-optic detection sensor, a plurality of FBGs having different reflection wavelengths are incorporated in a core section of one optical fiber to make it possible to simultaneously detect intrusion at a large number of positions.

This configuration has a structure in which FBG (Grating sections) 110A to 110N are incorporated in the core section of the optical fiber 110 at appropriate intervals and have different reflection wavelengths λ1, λ2, λ3, . . . . An optical signal generator 111 continuously or intermittently (pulsatively) generates an optical signal in a band including the reflection wavelengths held by the FBGs incorporated in the optical fiber 110. A half mirror 112 uses the optical signal from the optical signal generator 111 as an optical input to the optical fiber 110 to optically guide reflected lights from the FBGs of the optical fiber 110 to a narrow band variable filter 113. The narrow band variable filter 113 transmit the reflected waves from the FBGs at once to output these reflected waves to a photodetector 114. The photodetector 114 simultaneously converts the reflected waves into electric signals having equal frequencies or low frequencies obtained by multiplying the frequencies by 1/n. A wavelength shift detector 115 compares the frequency signals obtained by the photodetector 114 with a reference frequency signal from a reference frequency generator 116 to obtain pulse signals having timings sorted by reflection wavelengths the frequencies of which shift. An intrusion position determination section 117 determines a position of an FBG where a reflection wavelength shifts, i.e., an intrusion position on the basis of the timings of the pulse signals to obtain the output.

SUMMARY OF THE INVENTION

In a break-in detection apparatus or system using the FBG type fibro-optic detection sensor or the OTDR fibro-optic detection sensor, an optical fiber of the detection sensor is laid down along a side of a fence or a fence guard portion to make it possible to detect a touch on the optical fiber by an intruder, an occurrence of strain on the optical fiber by disconnection or demolition of the fence, or a disconnection of the optical fiber as an occurrence of intrusion. These fibro-optic detection sensors are better than other detection sensors in anti-EMI characteristic, weather resistance, maintenance-free characteristics, and the like. The fibro-optic detection sensors are preferably used as sensors for intrusion detection and surveillance.

However, when an intruder climbs over the fence without touching the optical fiber or ladders the fence and jumps over the fence guard, intrusion may be able to be detected by the means of the optical fiber.

As a method of solving the problem, a method of causing a vibration sensor to detect swinging of the fence when a person climbs or ladders the fence can be used. Furthermore, an infrared beam is emitted immediately near the fence to make it possible to detect interruption of the infrared beam by the intruder. An electric field interruption sensor is also arranged immediately near the fence to make it possible to detect that an intruder comes close to the electric field interruption sensor.

However, in these detection methods, an area which can be detected by one detection sensor is small (approximately several meters), and a large number of detection sensors must be installed to detect intrusion or the like in the entire area of the fence built around a wide area. A large number of detection signals from the sensors must be disadvantageously drawn into a surveillance room by a large number of signal cables.

It is an object of the present invention to provide a break-in detection sensor which uses an FBG type detection sensor to make it possible to detect intrusion by climbing a fence or jumping over the fence and which can detect intrusion in a wide area without large-scale equipment.

(Explanation of the Invention in Principle)

In general, a fence is mechanically weaker than a concrete wall or the like, and is swung when a person climbs or ladders the fence. When the fence is swung, stretch strains at FBGs (grating sections) of the optical fiber are generated by using the swinging of an optical fiber laid down on the fence. If the stretch strains can be discriminated as shifts of reflection wavelengths, intrusion can be detected even though an intruder climbs the fence without touching the optical fiber.

In consideration of this, the present invention provides a break-in detection sensor for detecting intrusion on the basis of swinging of an optical fiber due to swinging of a fence.

In order to make it possible to detect intrusion on the basis of swinging of the optical fiber, an improvement in sensitivity of the detection sensor, i.e., a laying structure of an optical fiber in which a stretch strain generated at an FBG of the optical fiber increases with respect to an amount of swinging of the fence, a configuration in which the capability of discrimination of wavelength shift detection of reflected waves is improved, and a configuration including the laying structure and the configuration may be achieved. However, when the sensitivity of the detection sensor is improved, intrusion may be erroneously detected when the optical fiber is swung by snow or wind and touched or swung by a person for fun. In order to avoid these erroneous intrusion detections, it is expected that sensitivity adjustment and maintenance of the detection sensors depending on different installation environments are time-consuming and that reliable determination cannot be easily performed.

In the present invention, when the optical fiber is swung when an intruder climbs or ladder the fence or swung by other factors such as snow or wind, aspects (patterns) changing depending on the sizes, generation period, or the like of wavelength shifts of reflected wave to be detected exhibit. In this consideration of this fact, a break-in detection sensor makes it possible to accurately discriminate other factors and adjusts the values of pattern data for pattern recognition by an automatic learning function. According to the above, the present invention has the following configuration as a characteristic feature.

(1) A break-in detection sensor of an FBG type in which FBGs (grating sections) of different types having different refractive indexes of fiber glass are arranged at predetermined intervals in a longitudinal direction of an optical fiber, the optical fiber is laid down on at least one of the top and side of a fence installed along an area to be detected, reflected waves from the FBGs are issued in response to an optical input to the optical fiber, and a position of an FBG which exhibits a wavelength shift is detected as an intrusion position, includes detection means for detecting a reflective wavelength shift from the FBG caused by swinging of the optical fiber by stress acting on the fence to detect intrusion by an aspect of the wavelength shift.

(2) The detection means includes light detection means for detecting reflective wavelength shifts from the FBGs as changes in frequency of electric signals, wavelength shift detection means for detecting positions of the wavelength-shifted FBGs by comparison between frequency signals and a reference frequency signal as differences between timings of pulse signals, and pattern recognition means for discriminating swinging of the fence by an intruder from the fence from swinging of the fence by other factors on the basis of output patterns (aspects) of the pulse signals.

(3) The pattern recognition means has a pattern table in which combinations of items sorted by different manners of intrusion from the fence, items sorted by the other factors, and items sorted by the output patterns of the pulse signals are set as table data, and the pattern table is compared with the output patterns of the pulse signals to discriminate the swinging of the fence by intrusion from the swinging of the fence by the other factors.

(4) The pattern recognition means includes means for automatically adjusting values of the pattern table by a learning function.

(5) The detection means has a configuration in which detection of the reflected waves from the FBGs is performed by calculating averages a plurality of times.

(6) The detection means has a configuration in which a final decision is made by performing intrusion detection a plurality of times.

As described above, a break-in detection sensor according to the present invention detects swinging of an optical fiber with swinging of a fence. For this reason, intrusion by climbing the fence or jumping over the fence by using a ladder can be detected by an FBG type detection sensor, and intrusion can be detected in a wide area without large-scale equipment.

Since the generation pattern recognition means for wavelengths shifts of the FBG type optical fiber is arranged, intrusion and other factors can be discriminated from each other at high accuracy.

Since the automatic learning function is given to the pattern recognition, appropriate recognition depending on installation environments of the detection sensors and other changes can be achieved, a trouble of adjusting pattern data or the like can be reduced.

DETAILED DESCRIPTION OF THE PREFERRED EMBODIMENTS

Figure 1:
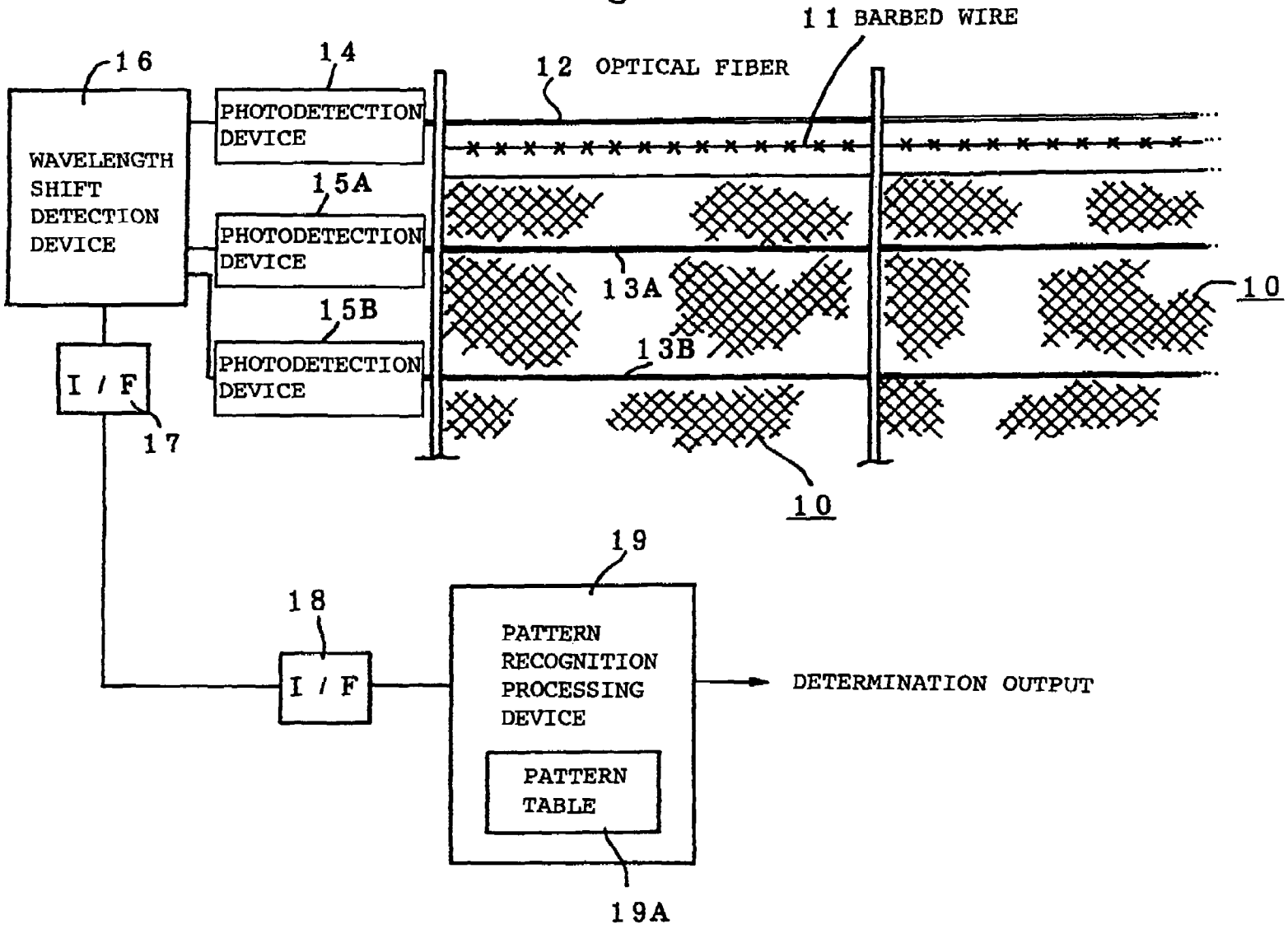
FIG. 1 is a block diagram of a break-in detection sensor according to an embodiment of the present invention.

FIG. 1 is a block diagram of a break-in detection sensor according to an embodiment of the present invention. A fence 10 installed along an outline of premises has an articulated structure of a large number of fence units. If needed, a barbed wire 11 is stretched between poles on the top of the fence 10, and a FBG type optical fiber 12 is laid down in parallel to the barbed wire 11. An FBG type optical fiber (one or more optical fibers) are laid down in zigzags or linearly on a side of the fence 10. FIG. 1 shows a case in which two FBG type optical fibers 13A and 13B are laid down.

Figure 5:
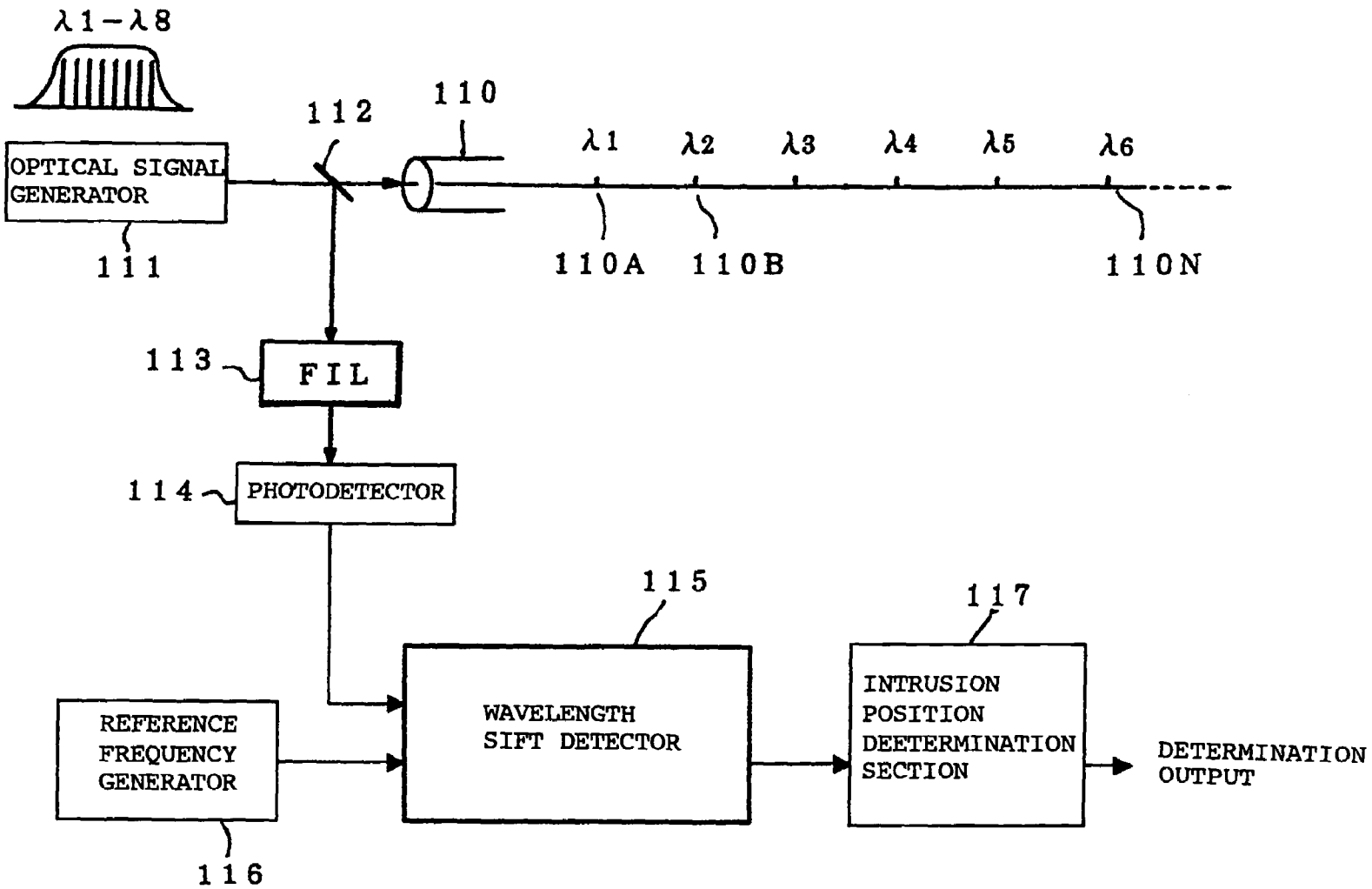
FIG. 5 is a diagram for explaining a relationship between wavelengths and intrusion position detection in an FBG system.

Photodetection devices 14, 15A, and 15B are arranged at one end of the FBG type optical fibers 12, 13A, and 13B to detect reflected waves from the optical fibers as frequency signals. Each of the photodetection devices 14, 15A, and 15B is constituted by, as in FIG. 5, a half mirror 112, a filter 113, and a photodetector 114. A wavelength shift detection device 16 which fetches detection signals from the photodetection devices 14, 15A, and 15B is constituted by, as in FIG. 5, a reference frequency generator 116 and a wavelength shift detector 115 to obtain reflected waves output from the optical fibers and having wavelength shifts equal to or larger than a predetermined threshold value as timings of pulse signals.

Detection sensitivities achieved by the photodetection devices 14, 15A, and 15B and the wavelength shift detection device 16 are designed to be higher than conventional ones to make it possible to extract and discriminate small swinging actions of the fence by climbing the fence or wind and snow as generation of wavelength shifts of the reflected waves from the optical fiber. Furthermore, as means for improving the detection sensitivities, mechanical means which can give large stretch strains to the optical fibers 12, 13A, and 13B by swinging of the fence is preferably arranged. This means is realized by attaching a weight having an appropriate weight to the optical fiber 12 at an intermediate position between poles of the fence, by attaching a weight to a side of the fence to engage the weight to the FBG optical fibers 13A and 13B, or by a barbed wire configuration in which barbed members consisting of a synthetic resin or a metal are arranged at appropriate intervals in a longitudinal direction of an optical fiber.

An interface 17 parallel transmits (serially transmits) detected pulse signals from the wavelength shift detection device 16 to a surveillance room, causes an interface 18 in the surveillance room to fetch these pulse signals, and obtains the demodulated pulse signals.

A pattern recognition processing device 19 compares aspects (pulse patterns) exhibited by the pulse signals fetched by the interface 18 with a pattern table 19A to discriminate swinging by an intruder from swinging by other factors such as wind, thereby determining the presence/absence. A method for determining the presence/absence of intrusion realized by the pulse patterns will be described below in detail.

(A) Classification of Stresses Acting on Fence

Stresses acting on a fence are different in position and strength, and wavelength shift positions and wavelength shifts of reflected waves from optical fibers change depending on the stresses. A generation aspect of a stress caused when wind or something knocks the fence is different from a generation aspect of a stress caused when an intruder climbs the fence. For example, when wind knocks the fence, although a frequency (vibration cycle) of a stress acting on the fence is high, the stress has a small displacement magnitude is small, and the stress uniformly acts on the entire area of the fence. On the other hand, a stress caused by collision on a fence acts on a limited part of the fence and has a low frequency and a large displacement magnitude. A stress caused by climbing a fence moves to various positions and has a frequency lower than that caused by wind and a large displacement magnitude. When a fence is swung for fun, a stress acts on a limited position of the fence.

As in the above example, stresses acting on a fence exhibit various aspects depending on factors as shown in the following table. Stretch strains of an optical fiber caused by the stresses, i.e., shifts of reflected waves and generation patterns thereof are different from each other.

TABLE 1

| | Application Breakdown | Frequency | Displacement Magnitude | Displacement Position | Movement of Displacement Position |
|---|---|---|---|---|---|
| 1 | Wind | High | Medium | Wide Area | No |
| 2 | Climbing | Medium | Large | Limited | Yes |
| 3 | Collision | Low | Large | Limited | No |
| 4 | Demolition | Low | Small | Limited | No |
| 5 | Swinging | Medium | Indetermination | Limited | Yes |

In the above table, comparison is performed in a predetermined period of time. The displacement position relates the presence/absence of movement on a side of the fence between fence poles.

(B) Aspect of Pulse Pattern Generated by Stress

Figure 2:
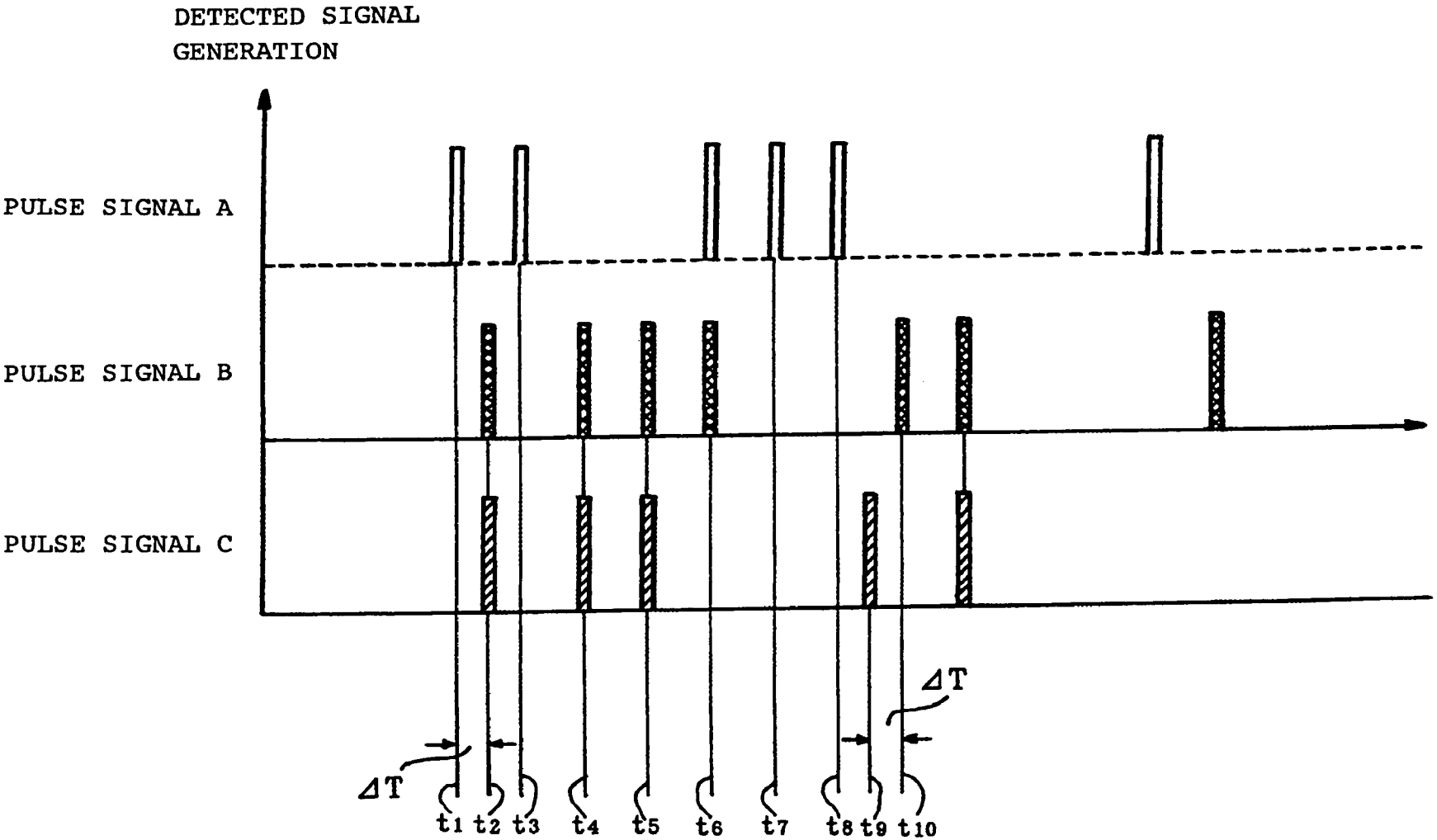
FIG. 2 is an example of a pulse signal string detected by a wavelength shift detection device in FIG. 1.
Figure 3:
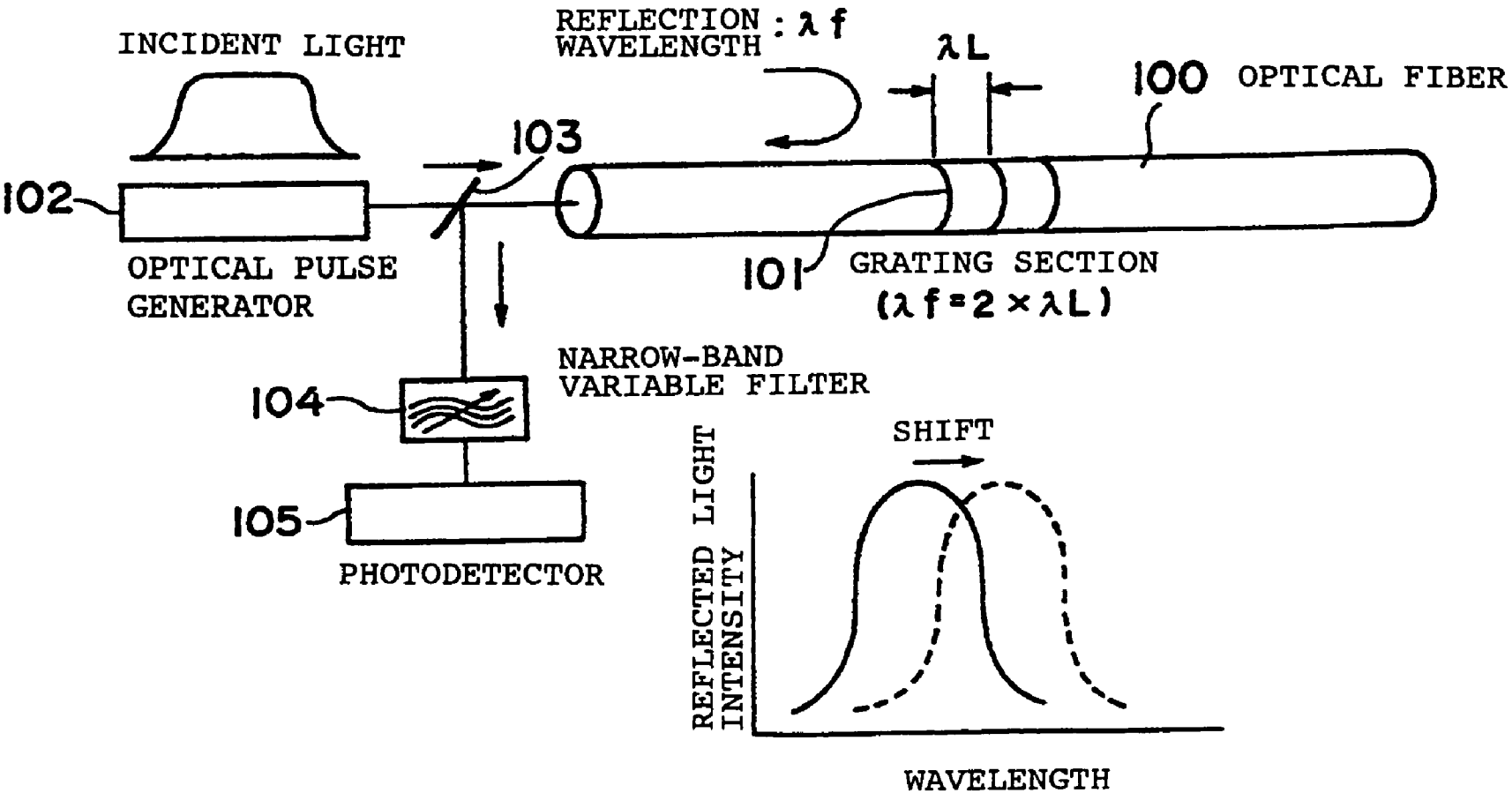
FIG. 3 is a diagram for explaining the principle of an FBG type detection sensor.
Figure 4:
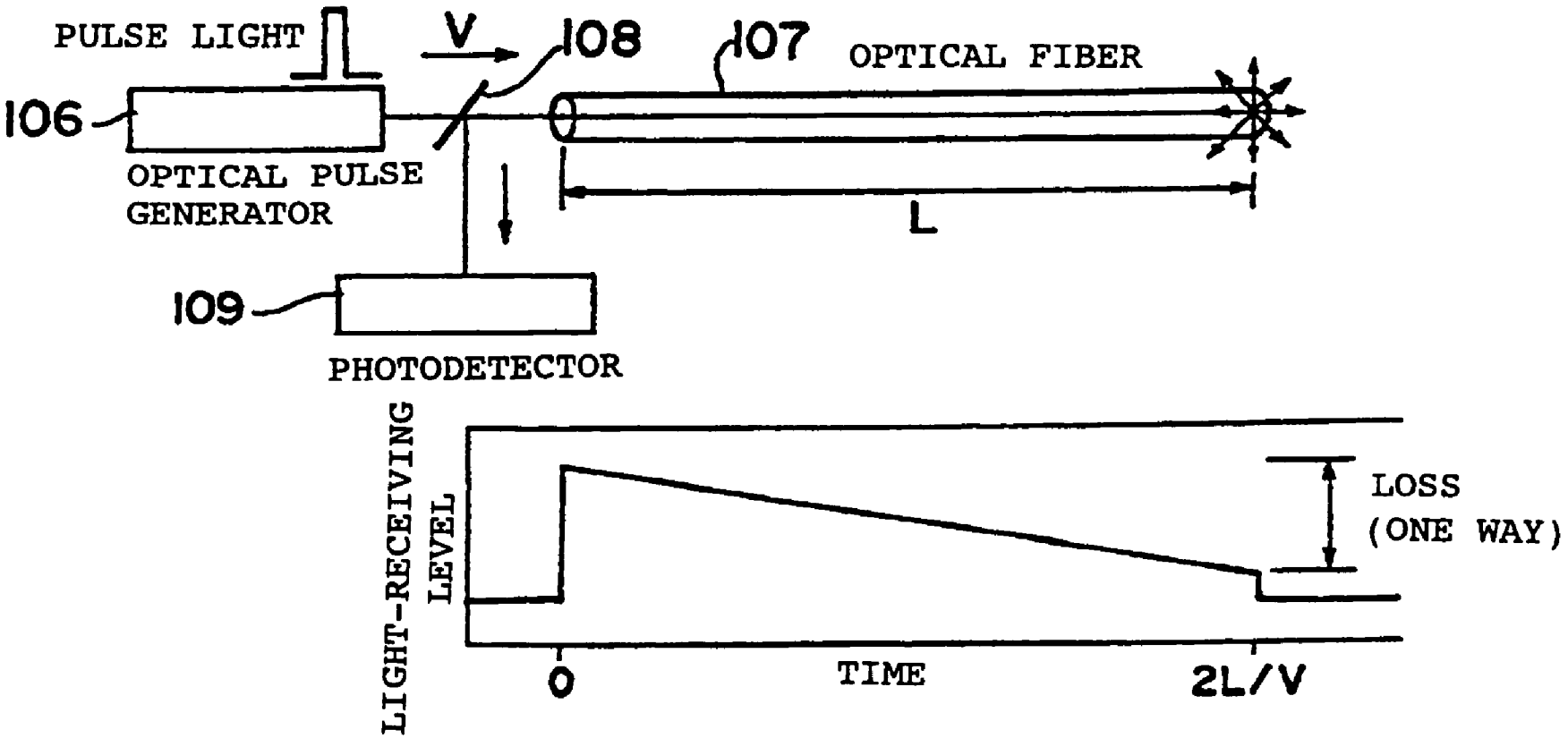
FIG. 4 is a diagram for explaining the principle of an OTDR type detection sensor.

FIG. 2 shows an example of aspects of wavelength shifts of reflected waves generated on the optical fibers 12, 13A, and 13B by a stress acting on the fence 10. A pulse signal A is output when a reflected wave shift obtained by a stress acting on the optical fiber 12 exceeds a predetermined threshold value. Similarly, pulse signals B and C are output when reflected wave shifts obtained by stresses acting on the optical fibers 13A and 13B exceed a predetermined threshold value.

As shown by the pulse signals A, B, and C, the lengths of generation cycles and the levels of generation frequencies of the pulse signals A, B, and C change depending on swinging generation factors of the fence, and generation timings of the pulse signals A, B, and C may have time differences.

For example, even though swinging occurs at the same fence position, a time difference ΔT may be generated at generation time t1 of the pulse signal A and generation time t2 of the pulse signal B, and both the pulse signals A and B may be generated at the same timing as at time T6. Similarly, depending on the aspects of wavelength shifts of reflected waves generated by the optical fibers 13A and 13B, the lengths of generation cycles, the levels of generation frequencies, and the generation timings of the pulse signals B and C have time differences.

(C) Data Configuration of Pattern Table

As described above, stresses acting on a fence are caused by various factors, and pulse patterns generated by these stress factors have various aspects. The pattern table 19A includes, as table data, combinations of items sorted by manners of intrusion from the fence, items sorted by other factors, and items sorted by output patterns of pulse signals. The table data is shown in the following table.

TABLE 2

| | Application Breakdown | ΔT | Frequency of Signal B | Frequency of Signal C |
|---|---|---|---|---|
| 1 | Wind | No | High/Low | High/Low |
| 2 | Climbing | Large | High | High |
| 3 | Collision | Small | High | High |
| 4 | Demolition | Large | Small | Small |
| 5 | Swinging | Medium | High | High |

In this table, as the breakdowns of the stresses acting on the optical fibers 13A and 13B, items, i.e., "wind", "climbing", "collision", "demolition", and "swinging" are set to a fence. Sizes of generation time delays ΔT of the pulse signals B and C and the measures (generation frequencies) of the numbers of pulse signals B and C are set as items. Although the values of the pattern table constituted by combinations of the items are expressed by "measure" and "level", the items are actually set as numerical values.

As the breakdowns of stresses acting on the optical fiber 12, for example, the table data corresponding to Table 1 are constituted.

(D) Determination of Stress Factor Using Pattern Table

The pattern recognition processing device 19 includes the pattern table 19A corresponding to Table 1 and Table 2 with reference to the pulse signals A, B, and C transmitted from the wavelength shift detection device 16. For example, time delays ΔT and generation frequencies in the pattern table shown in Table 2 are compared with each other with respect to the pulse signals B and C to determine a stress factor where all the values coincide with each other or almost coincide with each other. On the basis of the stress factor, swinging caused by "wind", swinging caused by "climbing" a fence, and the like are discriminated from each other.

More specifically, in an intrusion determination based on amounts of change of FBG portions generated in the optical fiber 12, in order to detect an act performed by climbing over the fence in the optical fiber, when the fence is climbed over, stresses caused by "gripping", "hooking on", "drawing in", and "holding on" the fence are discriminated from stresses caused by other factors such as wind to determine intrusion. Furthermore, in intrusion determination based on amounts of change of FBG portions generated in the optical fibers 13A and 13B, demolition of the fence or a climbing action of the fence is detected. For this reason, on the basis of portions of stresses acting on the fence, amounts of change of the portions, and a time difference between acting manners of the stresses at the respective positions, the stresses can be discriminated from stresses caused by other factors such as wind to determine intrusion.

As described above, in the break-in detection sensor according to the embodiment, a difference between factors of occurrence of swinging of the fence can be recognized as a pattern on the basis of a difference between generation frequencies of wavelength shifts and a difference between shifts to make it possible to achieve intrusion detection which accurately discriminates swinging of an optical fiber by an intruder who climbs or ladders the fence from swinging of the optical fiber by other factors such as wind and snow. However, as the sensor configuration, conventional equipment in which two (or three or more) optical fibers are laid down can be used without any change. In other words, the detecting function of the conventional equipment can be extended to detection of climbing the fence or jumping-over the fence.

The embodiment shows a sensor configuration in which intrusion detection is performed by using a pattern table including generation frequencies of pulse signals detected by three optical fibers and time delays of both the signals parameters. However, these parameters can be properly changed in design. For example, a configuration in which intrusion detection by swinging a fence is performed by only the optical fiber 12, or a configuration in which a plurality of optical fibers 12 can be used, or a configuration in which a plurality of optical fibers 13A, and a plurality of optical fibers 13B are arranged on the fence at proper intervals to detect intrusion by combinations of generation frequencies and time delays of pulse signals A to N detected by reflected waves from the optical fibers can be used. Furthermore, generation cycles (frequencies) of the pulse signals are included in the parameters of the pulse patterns, and a determination is performed on the basis of the parameters including the cycle factors.

The values of the pattern table are not fixed, and are appropriately changed depending on the environment of a region in which the break-in detection sensor is installed. The table values are differently adjusted when the break-in detection sensor is installed in a region where strong wind blows and when the break-in detection sensor is installed in a region where moderate wind blows. When the break-in detection sensor is installed in a crowded place near a residential area, a fence is often swung. For this reason, the table values are adjusted to relatively high values.

The pattern recognition processing device 19 has an automatic learning function to make it possible to accurately discriminate swinging of a fence caused by other factors from swinging of the fence caused by intrusion, and sensitivities need not be frequently adjusted. For example, pattern recognition is performed by a neutral network method using generation frequencies or the like of pulse signals as parameters (characteristic amounts). The parameters are appropriately changed (weighting of parameters is adjusted) by a learning function using teacher data in accordance with changes of sensor installation environments or the seasons.

A determination of pattern recognition processing is not limited to a configuration in which intrusion is determined by performing pattern recognition once. The final determination may be obtained by performing intrusion detection a plurality of times to make it possible to improve the reliability of intrusion detection. Similarly, a photodetection device and a wavelength shift detection device detect reflected waves from the FBGs and detect wavelength shifts by calculating averages a plurality of times to make it possible to improve the reliability of intrusion detection.

What is claimed is:

1. A break-in detection sensor of a fiber Bragg grating (FBG) type in which FBGs (grating sections) of different types having different refractive indexes of fiber glass are arranged at predetermined intervals in a longitudinal direction of an optical fiber, the optical fiber is laid down on at least one of the top and side of a fence installed along an area to be detected, reflected waves from the FBGs are issued in response to an optical input to the optical fiber, and a position of an FBG which exhibits a wavelength shift is detected as an intrusion position, comprising detection means for detecting a reflective wavelength shift from the FBG caused by swinging of the optical fiber by stress acting on the fence to detect intrusion by an aspect of the wavelength shift.

2. The break-in detection sensor according to claim 1, wherein the detection means comprises light detection means for detecting reflective wavelength shifts from the FBGs as changes in frequency of electric signals, wavelength shift detection means for detecting positions of the wavelength-shifted FBGs by comparison between frequency signals and a reference frequency signal as differences between timings of pulse signals, and pattern recognition means for discriminating swinging of the fence by an intruder from the fence from swinging of the fence by other factors on the basis of output patterns (aspects) of the pulse signals.

3. The break-in detection sensor according to claim 2, wherein the pattern recognition means has a pattern table in which combinations of items sorted by different manners of intrusion from the fence, items sorted by the other factors, and items sorted by the output patterns of the pulse signals are set as table data, and the pattern table is compared with the output patterns of the pulse signals to discriminate the swinging of the fence by intrusion from the swinging of the fence by the other factors.

4. The break-in detection sensor according to claim 2, wherein the pattern recognition means includes means for automatically adjusting values of the pattern table by a learning function.

5. The break-in detection sensor according to claim 1, wherein the detection means has a configuration in which detection of the reflected waves from the FBGs is performed by calculating averages a plurality of times.

6. The break-in detection sensor according to claim 1, wherein the detection means has a configuration in which a final decision is made by performing intrusion detection a plurality of times.

* * * * *